United States Patent [19]

Pagen et al.

[11] 3,989,616

[45] Nov. 2, 1976

[54] PRODUCTION OF LUBRICATING OILS BLENDING STOCKS AND SELECTED COMPONENTS FOR ASPHALT PRODUCTION

[75] Inventors: Charles A. Pagen, Woodbury; Richard J. Petrucco, Laurel Springs, both of N.J.

[73] Assignee: Mobil Oil Corporation, New York, N.Y.

[22] Filed: Aug. 30, 1974

[21] Appl. No.: 501,954

[52] U.S. Cl. ..... 208/6; 208/4; 208/18; 208/23; 208/39; 208/41; 208/357

[51] Int. Cl.² ..... C10C 3/04; C10C 3/06

[58] Field of Search ..... 208/4, 6, 18, 309, 349, 208/357, 23, 39, 41, 22

[56] References Cited

UNITED STATES PATENTS

| | | | |
|---|---|---|---|
| 2,991,241 | 7/1961 | Renner | 208/4 |
| 3,131,140 | 4/1964 | Brice et al. | 208/4 |
| 3,350,295 | 10/1967 | Hamner et al. | 208/4 |
| 3,481,863 | 12/1969 | Donaldson et al. | 208/210 |
| 3,488,283 | 1/1970 | Button et al. | 208/316 |

*Primary Examiner*—Herbert Levine
*Attorney, Agent, or Firm*—C. A. Huggett; M. G. Gilman; C. D. Farnsworth

[57] ABSTRACT

The production of normal and premium lube grade blending stocks of 100, 300 and 700 second neutral material along with high boiling by-product material for the manufacture of asphalts is improved by using a low pressure vacuum tower provided with an overflash separation in the tower bottom from resid.

14 Claims, 2 Drawing Figures

PRODUCTION OF LUBRICATING OILS BLENDING STOCKS AND SELECTED COMPONENTS FOR ASPHALT PRODUCTION

BACKGROUND OF THE INVENTION

Lubricating oils and asphalts of normal and premium grades have been developed over the years for many different applications. Whatever the use intended, a lubricating oil or an asphalt must be stable, have a high flash point and retain their special properties over an extended operating period. Separation of the crude into base stocks of different viscosities is usually carried out by vacuum distillation followed by separate treatment of each fraction by solvent extraction and sometimes hydrofinishing in specific applications. The facilities relied upon for processing available crudes are dependent upon the quality of the crude processed and the characteristics of the product desired. These considerations have grown in importance as the improvement in quality of product has increased. In the prior art systems large quantities of available crude were processed to prepare desired products. However, with the present scarcity of available crude, it is important to provide a process which will reduce the quantity of crude processed without reducing the quality of product produced. The present invention is directed to such an improved process.

SUMMARY OF THE INVENTION

This invention relates to the preparation of lubricating oils and asphalts. In a more particular aspect the present invention is concerned with an improved combination of processing steps for preparing more select lubricating oil and asphalt blending stocks. More particularly the present invention relates to an improved vacuum tower operation for the separation of more select fractions of lube oil blending components and components for asphalt production. In a particular aspect the present invention is directed to the recovery of 100, 300 and 700 second neutral fractions of a selected boiling range which are more amenable to solvent extraction processes and hydrofinishing thereof under conditions particularly restricting the volume of oil charge required to produce a given volume of desired lube oil and asphalt blending stocks.

DISCUSSION OF SPECIFIC EMBODIMENTS

In the combination operation of the present invention comprising vacuum distillation, furfural extraction, methyl ethyl ketone-aromatic extraction and hydrofinishing, it has been found particularly advantageous to rely upon a low pressure drop vacuum distillation tower operation designed to operate at a bottom pressure no higher than 50 mmHg and preferably it is retained at a bottom pressure of about 40 mmHg or lower. More particularly, to improve upon the quality of asphalt producing components, the vacuum tower of the present invention withdraws an overflash fraction from the lower portion of the tower higher boiling than a recovered 700 second neutral fraction, which is passed to a PDA extraction zone with a portion of the remaining vacuum tower bottom residue.

By practicing the processing concepts of the present invention it has been determined that the capital investment of the combination is lowered by as much as 10 percent; the utility consumption is lowered by as much as 30 percent; the crude requirements of the process are lowered by as much as 15 percent; the quality of the lube product is improved and more high melting point paraffin wax is obtained by the process.

In the combination operation of this invention, the vacuum tower relied upon to separate for example Middle East crude into desired lube oil base stocks is maintained at a bottom pressure lower than normally employed heretofore in a packed tower design providing not more than about 15 mmHg pressure drop. The vacuum tower is maintained under conditions providing a flash zone temperature within the range of 690° to 735° F. and a top temperature within the range of 120° to 135° F. The low pressure drop tower design of this invention permits the more select recovery of 100, 300 and 700 second neutral fractions or other fractional variations thereon such as a two mode operation comprising a 250 second neutral or a 450 second neutral fraction along with an overflash fraction as identified in the table below.

The vacuum tower design of the present invention is thus novel in design; a low operating pressure in conjunction with low pressure drop preferably less than 15 mmHg obtained preferably by use of essentially a packed column containing very few, if any, distillation plates. The vacuum tower design and method of operation is unique in that it permits the recovery of more select and narrow boiling range fractions processed to the blending stocks desired through solvent extraction and hydrofinishing.

Table 1

| % | 100"N° F. | 300"N.° F. | 700"N° F. | Overflash ° F. |
|---|---|---|---|---|
| 5 | 682 | 800 | 897 | 995 |
| 10 | 689 | 810 | 914 | 1010 |
| 30 | 718 | 833 | 944 | 1046 |
| 50 | 737 | 857 | 960 | 1067 |
| 70 | 758 | 875 | 982 | 1104 |
| 90 | 786 | 905 | 1015 | 1164 |
| 95 | 800 | 915 | 1029 | 1198 |

The lube oil fractions of Table 1 recovered from the vacuum tower as herein described are then subjected to a sequential treatment of furfural extraction and MEK extraction. Polycyclic materials are undesirable in lubricating oils because of their low viscosity indexes and poor stability. The polycyclic aromatics are removed in the combination of this invention by furfural extraction. The furfural extraction operation shown in block flow arrangement consists of facilities or tower arrangements suitable to contact the oil charge with the selective solvent plus facilities to separate the solvent from extract and raffinate streams. In this operation, the solvent is vaporized and the heat requirements for this purpose are normally high. Therefore any savings which can be obtained in this high cost area greatly contributes to the efficiency of the operation. In the specific operation of the present invention processing more select boiling range fractions of 100, 300 and 700 second neutral fractions, the extraction operating conditions can be refined to a point that considerable savings are realized not only in the quantity of material processed but also in the volumes of solvent required and the heat requirements of the operation. Thus processing the more select and restricted boiling range materials recovered as hereinbefore described avoids solvent overtreating the low boiling component portion of the particular fraction as well as an insufficient solvent treatment of the high boiling components of the fraction. These savings also contribute significantly to equipment savings as mentioned herein.

More specifically the furfural extraction of the 100 second neutral fraction may be accomplished with 175 percent volume furfural based on charge at an effective temperature of about 195° F. when maintaining the furfural extraction tower gradient, top/bottom of about 220°/180° F.

The 300 second neutral fraction may be furfural extracted with 200 percent volume solvent based on charge at an effective temperature of about 205° F. and a tower temperature gradient from top to bottom of about 230°/190° F.

The 700 second neutral fraction, on the other hand, may be furfural extracted with 225 percent volume solvent based on charge at an effective temperature of about 250 and a tower temperature gradient from top to bottom of about 265°/235° F.

The relatively narrow cut lube oil fractions herein defined following the removal of undesired polycyclic aromatics are then subjected to a further extraction to accomplish solvent drawing with the solvent (MEK) methyl ethyl ketone-aromatic aromatic solvent. The ketone solvent causes wax to solidify into a filterable crystalline form. The aromatic component of the solvent increases the oil dissolving capacity of the solvent. In the MEK (methyl ethyl ketone) extraction operation, the wax bearing oil charge is mixed with the solvent and the mixture is chilled to crystallize the wax. The chilled feed is continuously filtered to recover a wax cake. The MEK dewaxing operation is accomplished at a few degrees below in the range of 5° to 20° below the pour point of the product oil desired. Thus a filtrate comprising oil and solvent is recovered which is then separated to recover a dewaxed oil fraction from the solvent material.

In the combination operation of this invention a 50/50 MEK/toluene solvent composition is generally relied upon to accomplish dewaxing of the specific lube oil fractions. This may be varied either way by about 25 vol. percent. The filtration temperature for the 100 second neutral is about −20° F.; for the 300 second neutral about −15° F; and about 5° F. for the 700 second neutral material. The amount of solvent employed in the various steps of MEK solvent dewaxing will vary with each fraction but will be kept to a minimum consistent with obtaining desired results.

The overflash fraction recovered from the lower portion of the vacuum tower is combined with a portion of the vacuum resid and passed to propane deasphalting. In a specific example it is contemplated combining, based on crude charge, about 4 volume percent of the overflash with a portion of the vacuum resid varying from about 10 to 60 volume percent as feed to a PDA (propane deasphalting unit). Bright stock viscosities may be varied by varying the amount of resid passed to the PDA unit. In the PDA unit the above defined mixture is treated with propane solvent near its critical temperature which dissolves the hydrocarbon phase and rejects the asphaltic materials. In the combination of this invention, this separation is enhanced by the recovery of overflash material which is combined with a desired portion of the resid withdrawn from the bottom of the vacuum tower. In the range of conditions used in the PDA operation such as 100° to 150° F. in the bottom and from 150° to 180° F. at the top of the tower, raising the temperature of the propane reduces its dissolving capacity but improves its selectivity. On the other hand, increasing the propane to oil ratio further increases the separation sharpness. The operating pressure is sufficient to retain the propane in liquid phase. The heavy oil product of PDA treatment is thereafter subjected to furfural and MEK treatment under conditions particularly selected to retain the oil product in substantially maximum yields.

The drawing FIG. 1 is a schematic arrangement in block flow representing the processing combination of the present invention. In the arrangement of the drawing, a crude oil charge is introduced by conduit 2 to a vacuum distillation column 4 maintained at a bottom pressure of about 40 mmHg. The tower 4 is primarily a packed volumn arranged for about 15 mmHg pressure drop. The vacuum tower is operated under conditions selected to produce the fractions identified in Table 1 above along with a gas oil fraction withdrawn from an upper portion of the tower by conduit 6 and a resid material withdrawn from the bottom of the tower by conduit 8. In a specific operation, the gas oil fraction amounts to about 10 vol.% of the charge and the resid is about 11.5 vol.% of the charge. A 100 second neutral fraction is withdrawn by conduit 10 and amounts to about 8.6 vol.% of the charge. Any excess of this material over that desired to be processed may be withdrawn by conduit 12. A 300 second neutral oil fraction amounting to about 7.5 vol.% of the charge is withdrawn by conduit 14 and separated into stream 16 for use in preparing normal oil blending stock and stream 18 for use in preparing premium oil blending stocks. An overflash boiling range material identified in Table 1 and amounting to about 4.0 volume % of the feed is withdrawn from a lower portion of the vacuum tower above the charge inlet by conduit 26. A portion of the vacuum tower resid withdrawn by conduit 8 is withdrawn by conduit 28 and combined with overflash material in conduit 26 before passage by conduit 30 to a PDA unit 32. In the PDA unit, the blend of overflash with resid and operating conditions relied upon are such as to provide an oil product comprising about 48.8 vol.% of the charge thereto which oil product is withdrawn therefrom by conduit 34. An asphalt product of the process is withdrawn by conduit 36. The heavy oil product in conduit 34 is thereafter subjected to furfural extraction conditions for the removal of polycyclic material thereby providing a product therefrom amounting to approximately 68 vol.% of the oil stream charged thereto. The raffinate-oil product of extraction is then passed by conduit 38 to solvent dewaxing accomplished with a MEK/toluene solvent mixture. In this operation the conditions are selected to recover about 77 vol.% of the feed as a dewaxed oily product. The dewaxed oil is then passed by conduit 40 to a hydrofinishing operation wherein it is contacted with a hydrofinishing catalyst at a temperature within the range of 400° to 700° F. (prefer 450° F. to about 550° F.) and a pressure selected from within the range of 200 to 600 psig. In a specific operation a 95VI heavy lube oil bright stock in conduit 40 is hydrofinished to a color lighter than 5 ASTM. This product material will normally boil above about 900° F. and is withdrawn by conduit 42.

The 700 second neutral oil fraction in conduits 22 and 24 are passed to furfural extraction for the removal of polycyclic materials under conditions permitting the recovery of about 55 vol.% of the oil charge in conduit 22 by conduit 44 and about 45 vol.% of the oil charge in conduit 24 by conduit 46. The raffinate phase of furfural extraction recovered by conduits 44 and 46 are then passed to solvent dewaxing with MEK as herein described. In the solvent dewaxing operation the conditions are selected to permit the recovery of an oil product amounting to about 77 vol.% of the charge in conduit 44 by conduit 48 and about 66 vol.% the charge in conduit 46 by conduit 50. The oil product in conduit 48 prepared from 700 second neutral material will be about a normal 97 VI dewaxed material. This material produced for use as normal blending stock may be subjected to hydrofinishing conditions if desired. The premium oil blending stock recovered by conduit 50 is subjected to hydrofinishing temperature conditions and catalyst contact selected to improve the quality of this material suitable for use as premium blending stock. In this specific arrangement a 100 VI dewaxed material is produced and will be withdrawn from the hydrofinishing operation by conduit 52. The 300 second neutral material recovered from vacuum distillation is passed by conduit 16 and 18 to furfural extraction operation particularly designed to produce a normal oil product recovered by conduit 54 and a premium oil product recovered by conduit 56. The normal oil furfural raffinate amounts to about 55 vol.% of the oil charge and the premium oil raffinate amounts to about 45 vol. % of the oil charged. The raffinate streams in conduits 54 and 56 are then subjected to solvent dewaxing by MEK to produce dewaxed oil product recovered by conduit 58 and premium oil by conduit 60. The normal oil in conduit 58 may be hydrofinished if desired. This material will be about a 104 VI dewaxed material. The premium oil raffinate in conduit 60 is subjected to hydrofinishing conditions to remove aromatics and produce a stable turbine oil product. The hydrofinished premium oil is recovered by conduit 62 as a 108 VI dewaxed material (300 second neutral) for blending purposes. The 100 second neutral oil fraction recovered from the vacuum tower by conduit 10 is subjected to furfural extraction. A raffinate fraction amounting to about 54 vol.% of the 100 neutral charge is recovered by conduit 64 and separated into two streams 66 and 68. Each of the oil streams in conduits 66 and 68 are subjected to solvent dewaxing by MEK. In this operation about 78 vol.% of the oil charge in conduit 66 is recovered as a dewaxed oil in conduit 70 and about 83 vol.% of the charge in conduit 68 is recovered as a dewaxed premium oil blending component by conduit 72. The dewaxed (100 neutral) oil product recovered by conduit 70 is about a 106 VI material. The premium oil in conduit 72 is subject to hydrofinishing conditions to stabilize the oil before it is recovered by conduit 74 as a 110 VI dewaxed material.

In the combination operation herein described, a combined extract phase is recovered as by conduit 76 and a combined wax phase is recovered by means represented by conduit 78. To simplify understanding of the complex processing arrangement of the present invention relying upon known processing technology, the various furfural extraction steps, MEK solvent dewaxing steps and hydrofinishing step have been simply identified by rectangular block. It is to be understood however that because of the particularly improved vacuum fractions recovered and subsequently treated, that the overall processing combination reaps significant advantages as herein identified. More particularly, it has been found that by practicing the processing concepts of this invention that as much as 3000 barrels of crude oil can be saved over prior processing techniques for producing the equivalent amount of desired product blending stock. For example, when charging 15469 (BCD) barrels per calendar day, of reduced crude to the improved vacuum tower design and operation of this invention, the following product distribution may be obtained as identified in Table 2 below.

Table 2

| | | |
|---|---|---|
| 100″ | Normal | 521 BCD |
| 100″ | Premium | 14 BCD |
| 300″ | Normal | 849 BCD |
| 300″ | Premium | 239 BCD |
| 700″ | Normal | 348 BCD |
| 700″ | Premium | 259 BCD |
| 150″ | Base Stock | 770 BCD |
| Asphalt | | 1472 BCD |
| Furfural Extract | | 2875 BCD |
| Slack Wax | | 920 BCD |
| Refinery Fuel and Gas Oil Prod. | | 6802 BCD |

An important auxiliary benefit of practicing the processing concepts of the present invention is the production of more select components for asphalt production. More particularly, a full range of paving and industrial asphalts can be formulated from lube by-products by either direct blending and blending followed by oxidation. In a particular aspect, asphalt penetration grades 65, 90 and 200 have been formulated from blends of some or all of the following lube streams (consult block flow drawing) vacuum tower resid (stream 8), vacuum tower overflash (stream 6), PD asphalt (stream 36), and furfural extracts (stream 76)

The ability to formulate asphalt from lube by-products is a valuable adjunct to the present processing invention for the following reasons: (1) the cost of transporting, storing and processing special asphaltic crude on a blocked out refining operation is eliminated, (2) the lube by-products are upgraded from fuel oil to asphalt value, (3) the downgrading of 300° to 500° F. kerosine which must be blended with several of these high viscosity lube by-product streams to meet fuel oil specifications is eliminated.

By selective blending alone or selective blending followed by oxidation of these by-product streams, asphalts of highly superior quality can be produced. For example, a premium 90 penetration grade asphalt may be prepared by a selective blending plus oxidation of vacuum tower resid, vacuum tower overflash, and PD asphalt to provide the following properties shown in Table 3.

It will also be observed from the information presented herein that a large number of asphalts produced may be produced by simple blending to meet a vis-pen specification (which is found only in Australia) as hereinafter defined. These asphalts are of considerably lower quality and may not all meet specification tests. Furthermore, selective oxidation of the various blends may be relied upon to meet different penetration and viscosity requirements.

To illustrate the utility and value of using this approach to asphalt manufacture, the asphalt specifications of the Australian Road Research Board were selected as criteria for evaluation. These specifications are currently among the most stringent in the entire world. It is generally conceded by those skilled in the art of asphalt manufacture that an asphalt meeting the A.R.R.B. specification for a specific penetration grade would readily meet the less stringent specification of the other countries of the world including the United States. Thus, the technology developed has worldwide utility at other lube refineries and added value because of the projected increase in the future use of light crudes for asphalt manufacture.

Table 3

| | |
|---|---|
| Viscosity, CS at 158° F. | 485 |
| Penetration (77/100/5) | 86 |
| Vis-Pen | 41,700 |
| Softening Point, ° F. | 113 |
| Rolling Thin Film Oven Test Ductility at 59° F. | 85 |
| 1/16" Thin Film Oven Test Ductility at 77° F. | >140 |

DESCRIPTION OF SPECIFIC EMBODIMENTS

Figure 1:
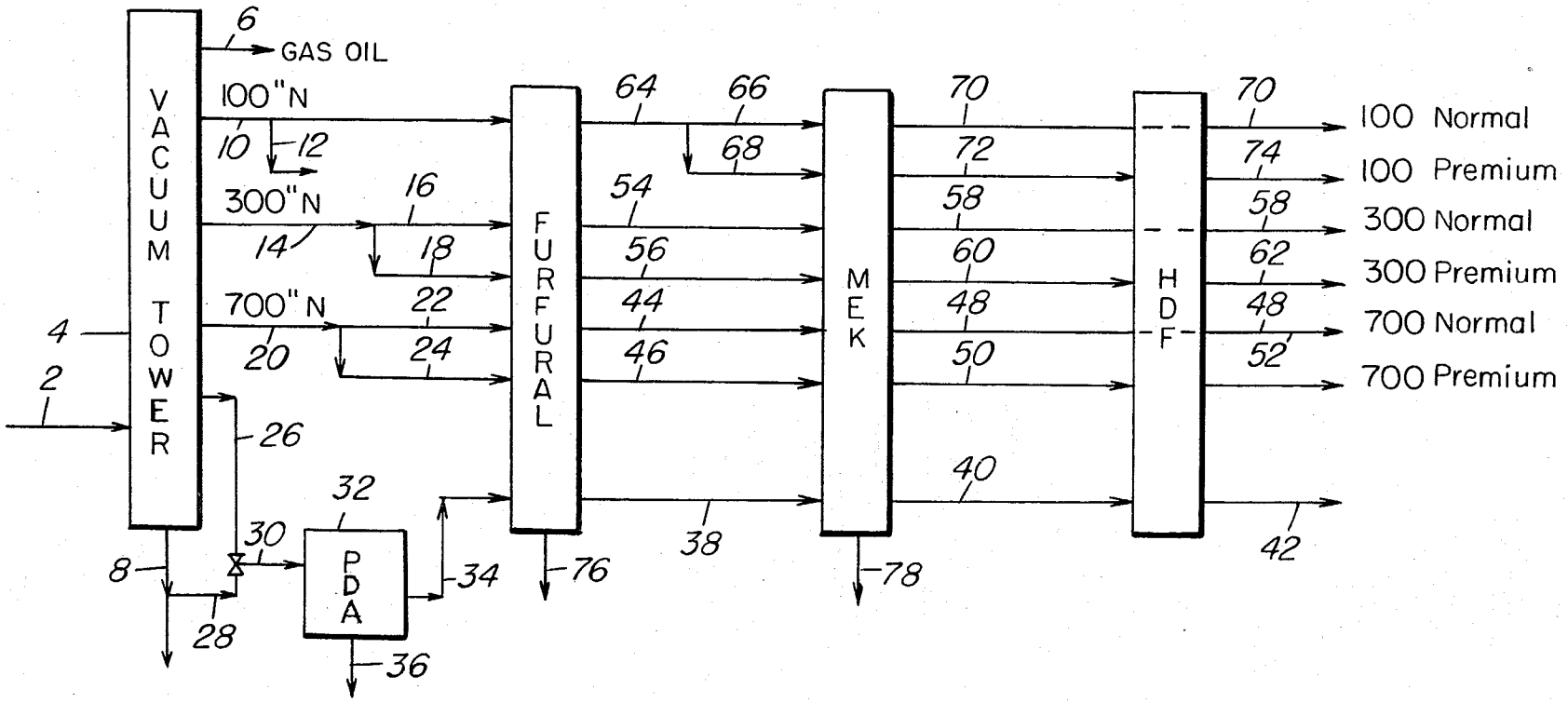

The asphalt products above identified and comprising paving grades R65, R90 and R200 vary in commercial importance with rade R90 accounting for a greater percentage of the Market. Current road asphalts have been produced in large part from Kuwait crude which yields in asphalt meeting the very strict specification. However, in view of the recent scarcity of this material, there is considerable economic incentive to develop other sources of asphalt. Tables 4 and 5 below list relatively strict Australian specification for the above grades of asphalt. Of these specifications, the most troublesome for asphalt to satisfy are:

1. Vis-pen requirement - This value is obtained by multiplying the viscosity (STOKES) at 158° F. (70 C.) by the penetration at 77° F. (25° C).

2. The Film Oven Test requirements — The three TFOT tests are:

a. ⅛ inch Thin Film Oven Test (TFOT) — ⅛ inch film of asphalt (50 cc sample) is heated in a cylindrical flat bottom pan at 325° F. (162.7° C.) for five hours. The weight change, penetration and often the ductility of the oxidized sample are then determined.

b. one-sixteenth Thin Film Oven Test (TFOT) — The same test conditions are used in this test as in the ⅛ inch TFOT but as the name implies a thinner asphalt sample (25 cc) is employed to allow for more severe sample oxidation.

c. Rolling Thin Film Oven Test (RTFOT). This test is also run at 325° F. (162.7° C.) but for a shorter period of time (1.25 hours). As indicated in the test's name, the sample container is continually rotated during the oxidation period resulting in a more uniform oxidation of the entire asphalt sample.

TABLE 4

Current (Australian Road Research Board) Specifications - General

| | Grade | | | | | |
|---|---|---|---|---|---|---|
| | Bitumen R 200 | | Bitumen R 90 | | Bitumen R 65 | |
| | min. | max. | min. | max. | min. | max. |
| Penetration, 100–5–77 | 180 | 210 | 85 | 100 | 60 | 70 |
| S.G., 77/77° F. | 0.97 | — | 0.98 | — | 0.99 | — |
| Flash Point, ° F. | 400 | — | 428 | — | 437 | — |
| Viscosity, Stokes at 158° F. (70° C) at 275° F. (135° C) | | | | | | |
| Softening Point, ° F. | 91 | 113 | 108 | 127 | 115 | 136 |
| Ductility - | | | | | | |
| cm at 77° F. (25° C) | — | — | 100 | — | 75 | — |
| cm at 59° F. (15° C) | 75 | — | — | — | — | — |
| cm at 39° F. (4° C) | 10 | 13 | 5 | — | 3 | — |
| Thin Film Oven Test (1/8") | | | | | | |
| (a) Wt. % loss at 325° F. for 5 hours | — | 1 | — | 1 | — | 1 |
| (b) Pen. of Res at 77° F. as % of orig. | 45 | — | 50 | — | 60 | — |
| (c) Ductility of Res. at 77° F. | 60 | — | 60 | — | — | — |
| Penetration 100–5–59 / Penetration 100–5–77 × 100 | 28 | — | 28 | — | 25 | — |
| Solubility in $CCl_4$, wt. % | 99.0 | — | 99.0 | — | 99.0 | — |
| South Aus./Adelaide Vis-pen | 30,000–60,000 | | 40,000–60,000 | | | |
| RTFOT | | | Ductility at 15° C Min. = 20 cm | | | |
| New South Wales TFOT (1/16") - Ductility at 25° C | | | Min. Ductility = 60 cm | | | |
| Vis-pen | 32,000–60,000 | | 40,000–60,000 | | | |
| Altoona TFOT (1/16") Ductility at 25° C | | | Min. Ductility = 60 cm | | | |

TABLE 5

Current A.R.R.B. Specifications - Required by Specific States

The specification requirements listed in Table 4 are common to all states. The following tests requirements are mandatory in the particular areas noted:

SOUTH AUSTRALIA (Highways Department)

Bitumen R 90 - Vis-pen 40,000 – 60,000

(A 10,000 range is nominated within these limits - 43,000–53,000 for product of Aramco origin and reference to the customer is necessary prior to alteration).

Rolling Film Oven Test (RFOT) according to Californian Test Method 346-C, March 1966 followed by ductility at 15° C (5 cm/min.). Minimum ductility requirement 20 cm.

Bitumen R 200 - Vis-pen 30,000 – 60,000

TABLE 5-continued

| Current A.R.R.B. Specifications - Required by Specific States |
|---|
| NEW SOUTH WALES (Department of Main Roads) |
| Bitumen R 90 - Vis-pen 40,000 – 60,000 |
| Thin Film Oven Test (1/16") followed by ductility at 25° C. (ASTM D 1754/D113). Minimum ductility requirement 60 cm. |
| Bitumen R 200 - Vis-pen 32,000 – 60,000 |
| OTHER STATES - Table 4 requirements plus |
| Vis-pen 40,000 – 60,000 for R 90 |
| Vis-pen 32,000 – 60,000 for R 200 |

In progressing the combination operation of this invention a program was pursued evaluating five lube refinery by-product streams hereinafter identified. The physical properties of the vacuum tower bottoms, the propane or solvent deasphalt tar, vacuum tower overflash and two furfural extract phases are provided in Table 6.

Table 6

PHYSICAL PROPERTIES OF LUBE REFINERY STREAMS

| Stream Source | V.T. Bottoms Paulsboro | P.D. Tar Gravenchon | V.T. Overflash Liquid Paulsboro | Bright Stock Furf. Ex. Gravenchon | Heavy Neutral Furf. Ex. Gravenchon |
|---|---|---|---|---|---|
| Dist. Range, ° F | 1085+ | — | 950–1100 | — | — |
| Yield % | 10.9 | — | 5.6 | — | — |
| Properties | | | | | |
| API Gravity | | — | 14.8 | 11.8 | 9.1 |
| KV (stokes) | | | | | |
| at 100° F (37.7°C) | | | | 44.63 | 8.32 |
| at 158° F (70° C) | 302 | >99,000 | 1.37 | 0.281 | 0.08 |
| at 275° F (135° C) | 2.93 | 6.31 | 0.11 | | |
| Penetration | | | | | |
| 77° F/100/5 | 121 | 18 | — | — | — |
| 59/100/5 | 36 | 6 | — | — | — |
| Ductility | | | | | |
| at 77° F. (25° C) | >140 | >140 | — | — | — |
| Softening Point | 107° F (41.6° C) | 131° F (55° C) | — | — | — |

The manufacture of R90 grade asphalt was attempted by blending 10 weight percent of P.D. (propane deasphalted) tar with vacuum tower bottoms material identified in Table 6. This blend (A57) comes within the penetration specification for the R90 grade asphalt but it is below the minimum vis-pen requirements of 40,000 provided in Tables 4 and 5. Increasing the P.D. tar concentration to 15 weight percent (blend A58) resulted in an asphalt which satisfied penetration specifications and had an improved vis-pen value of about 40,406. Attempts to formulate products with improved vis-pen values by increasing the P.D. tar concentration were not successful because the blends were below the minimum penetration specification. An approach was taken (Blend A71) containing 60 weight percent V.T. Bottoms (vacuum tower bottoms), 30 weight percent P.D. tar and 10 weight percent overflash liquid. This blend (A71) met neither the penetration of the vis-pen requirements. Decreasing the overflash liquid concentration to 5 weight percent (blend A72) brought the penetration to 100 which is a maximum for R90 material. Also, the vis-pen was below the 40,000 minimum. Reducing the overflash liquid to 2 weight percent (Blend A96) failed to meet minimum penetration R90 specification. Replacing a portion of the P.D. tar of blend (A96) with the softer vacuum tower bottoms (blend A74) provided an asphalt within the penetration which also met the Vis-pen specifications. The same result was obtained with blend A73 containing 35 weight percent P.D. tar and 5 weight percent overflash liquid. It is clear from the above that formulation of acceptable asphalt by simply blending of the various streams produced asphalts meeting the desired specification. To get an asphaltic material with even better physical properties, oxidation of various blends of the streams was attempted.

In an attempt to make an R90 specification asphalt a blend comprising 90 weight percent of V.T. Bottoms and 10 weight percent overflash liquid was prepared and subjected to oxidation conditions. The results obtained are summarized in Table 7.

TABLE 7

| Run No. | Oxidation of By-Product Stream Blend R-90 Grade F-8-8 | F-8-27[a] | Retests F-8-27 | A.R.R.B. Specs. |
|---|---|---|---|---|
| Composition, Wt. % | | | | |
| Vacuum Tower Bottoms | 90 | 90 | | |
| Overflash Liquid | 10 | 10 | | |
| Blends Oxidized to Penetration Grade[d] | | | | |
| Properties | | | | |
| Viscosity (stokes) | | | | |
| at 158° F (70° C) | 494 | 504 | — | |
| Penetration (77/100/5) | 90 | 89 | — | 85–100 |
| Vis-Pen | 44,460 | 44,856 | — | 40,000–60,000 |
| RTFOT | | | | |
| Ductility at 59° F (15° C) | 21.0/18.0[c] | 10/10[c] | 10/10[b][c] | 20 min.(Adelaide) |
| Loss on Heating, % | +.12 | +.14 | +.14[b] | 1.0 max. |

TABLE 7-continued

| | Oxidation of By-Product Stream Blend R-90 Grade | |
|---|---|---|
| TFOT (1/16") | | |
| Ductility at 77° F (25° C) | >140 | 60 min. (N.S. Wales & Altoona) |
| Loss on Heating, % | +.19 | 1.0 max. |

[a]Same compositon as F-8-8 but prepared at a later date
[b]Retest results on sample of F-8-27
[c]Fails specification
[d]Oxidation conditions: 480° F (248.9° C), 6.2 cu. ft. air/hr/gallon.

Oxidation of the above identified blend to the penetration range of R90 specification material resulted in an asphalt which meets the critical specifications except the ductility at 59° F. (15° C.) requirement after the (RTFOT) rolling thin film oven test. As observed in Table 7, blend F—8–8 met the critical specifications including the one-sixteenth inch TFOT and the vis-pen requirements. A reblending and test of a second sample of F8–8 failed to meet the minimum RTFOT ductility specification.

Oxidation of the above identified blend to the penetration range of the R-90 specification material, results in an asphalt which meets all of the critical specifications except the RTFOT ductility at 59° F. It must be remembered that RTFOT ductility is required in Australia and a few other countries. Hence as indicated by the one-sixteenth inch TFOT results, this asphalt would be acceptable in other known country requirements. to the other asphalts in Table 8 which do not meet the vis-pen requirement because the unique vis-pen requirement is found only in Australia's specifications. Decreasing the overflash concentration to 10 weight percent (blend F8–9) resulted in improved RTFOT ductility but failed to meet vis-pen requirements. The overflash was reduced to 8 weight percent (blend F8–31) and this blend was oxidized to grade specification. Blend (F8–31) meet all of the critical R90 specifications herein identified. Blend (F10–10) containing 7 weight percent overflash also met the vis-pen specification with a vis-pen value of 40296. Blend (F10–11) comprising 5 weight percent overflash provided a vis-pen value below the 40,000 specification minimum. Thus, from Table 8 it is seen that an asphalt containing 8 weight percent V.T. overflash, 30 weight percent P.D. tar and the remainder V.T. Bottoms (blend F8-31) and run F-10–10 containing 7wt.% overflash pro-

TABLE 8

| | Oxidation of By-Product Stream[a] R-90 Grade | | | | | |
|---|---|---|---|---|---|---|
| Run No. | F-8-20 | F-8-9 | F-8-31 | F-10-10 | F-10-11 | A.R.R.B. Specs. |
| Composition, wt % | | | | | | |
| V.T. Bottoms | 55 | 60 | 62 | 63 | 65 | |
| V.T. Overflash Liquid | 15 | 10 | 8 | 7 | 5 | |
| P.D. Tar | 30 | 30 | 30 | 30 | 30 | |
| Properties | | | | | | |
| Viscosity (stokes) at 158° F (70° C) | 430 | 445 | 485 | 438 | 434 | |
| Penetration (77/100/5) | 90 | 89 | 86 | 92 | 89 | 85–100 |
| Vis-Pen | 38,700 | 39,605 | 41,710 | 40,296 | 38,626 | 40,000–60,000 |
| Ductility (initial) | | | | | | |
| at 77° F (25° C) | >140 | >140 | >140 | | | 100 min. |
| at 39° F (3.9° C) | 9.0/10.0 | 8.0/8.0 | 8.0/8.0 | | | 5 min. |
| Pen $\frac{(59/100/5)}{(77/100/5}\times 100$ | | | 32 | | | 28 min. |
| Softening Pt. (° F, ° C) | 111° F (43.9° C) | 111° F (43.9° C) | 113° F (45° C) | | | 108° F (42.2° C)-127° F (52.8° C) |
| RTFOT | | | | | | |
| Ductility at 59° F (15° C) | 7.0/9.0 | 85/108 | 85/74 | 120/>140 | >140/>140 | 20 min. |
| Loss on Heating, wt % | | +.12 | +.13 | +.12 | +.12 | 1.0 max. |
| TFOT (1/16") | | | | | | |
| Ductility at 77° F (25° C) | >140 | >140 | >140 | | | 60 min. |
| Loss on Heating, wt % | +.13 | +.20 | ;30 .20 | | | 1.0 max. |
| TFOT (1/8") | | | | | | |
| Penetration (77/100/5) | | | 57 | | | 60 min. |
| As % of Orig. Pen | | | 67 | | | |
| Ductility of Residue at 77° F (25° C) | | | >140 | | | 60 min. |

[a]Oxidation conditions - 480° F (248.9° C), 6.2 cu. ft. air/hr/gal. Blends oxidized to penetration listed.

Each of the asphalts in Table 8 contains a substantial amount (30 weight percent) of P.D. tar. Blend F8–20 containing 15 weight percent V.T. overflash, 55 weight percent V.T. Bottoms and 30 weight percent P.D. tar failed to meet the RTFOT ductility and the vis-pen requirements. But here as noted before the asphalt would meet the demanding specification of asphalt users outside of Australia. This statement also applies vided satisfactory asphalts. However, in the event that the vis-pen specification is reduced below 40,000, other blends will provide satisfactory R90 asphalts as shown by Table 8.

The effect of varying the P.D. tar concentration from 30 weight percent was studied and is reported in Table 9.

TABLE 9

| | Oxidation of By-Product Stream Blend* R- 90 Grade | | | | |
|---|---|---|---|---|---|
| | F-9-24 | F-9-25 | F-8-21 | F-9-27 | A.R.R.B. Specs. |
| V.T. Bottoms | 62.5 | 62.5 | 80 | 40 | |
| P.D. Tar | 25.0 | 18.75 | 10 | 40 | |
| V.T. Overflash | 12.5 | 18.75 | 10 | 20 | |
| Viscosity (Stokes) at 158° F (70° C) | 489 | 456 | 445 | 365 | |
| Pentration 77/100/5 | 84 | 92 | 96 | 102 | 85–100 |
| Vis-Pen | 41,101 | 41,952 | 42,720 | 37,230 | 40,000–60,000 |
| RTFOT Ductility (59° F) (15° C) | 34/35 | 32/25 | 16/14 | 80/108 | 20 min. |

*Blends oxidized to penetration listed.

Reductions in the P.D. Tar concentration (blends F-9–24 and F-9–25 provided asphalts which would also meet the A.R.R.B. ductility requirements. Cutting the P.D. tar concentration to 10 wt.% resulted in an asphalt which met the vis-pen requirement but which fell below required ductility minimum. Increasing the P.D. tar concentration (blend F-9–27) containing 40 weight percent P.D. tar, 40 weight percent V.T. Bottoms and 20 weight percent V.T. overflash resulted in an asphalt with excellent RTFOT ductility but one which does not meet the vis-pen specifications.

A limited evaluation of combining furfural extracts with P.D. tar and V.T. Bottoms and then oxidizing such blends to grade could provide another option to the use of V.T. overflash liquid. For example, a blend containing 10 wt.% of Bright Stock furfural extract, 30 wt.% P.D. tar and 60 wt. % V.T. Bottoms met after oxidation all of the specification requirements of the R-90 grade asphalt herein identified. Similar results were obtained by substituting a heavy neutral furfural extract fraction boiling in the range of 840° F. to 1040° F. for the Bright Stock containing blend above identified.

The manufacture of R-200 grade asphalt was pursued by blending the V.T. overflash with the V.T. Bottoms to the penetration limits for R-200 material. From this work it was determined that satisfying the penetration specifications of R-200 material would permit using from 5 wt. to 10 wt.% V.T. overflash in the blend. To more clearly identify this limit blends A-54, A-82 and A-83 containing 7.5 wt.%, 8 wt.% and 8.5 wt.% overflash liquid were blended and tested. The data obtained are provided in Table 10 below.

TABLE 10

| | Blends of By-Product Streams R-200 Grade | | | | |
|---|---|---|---|---|---|
| Blend No. | A-54 | A-82 | A-82-1[a] | A-83 | A.R.R.B. Specs |
| Composition, wt % | | | | | |
| Vacuum Tower Bottoms | 92.5 | 92.0 | 92.0 | 91.5 | |
| Overflash Liquid | 7.5 | 8.0 | 8.0 | 8.5 | |
| Properties | | | | | |
| Penetration 77/100/5 | 181 | 205 | 206 | 209 | 180–210 |
| 59/100/5 | | | 63 | | |
| Viscosity (stokes) 158° F (70° C) | 214 | 167 | 164 | 162 | |
| Vis-Pen | 38,734 | 34,235 | 33,784 | 33,858 | 30,000–60,000 |
| Ductility 59° F (15° C) | 140 | 140 | 140 | 140 | 75 min. |
| 39° F (4° C) | 100 | 100 | 100 | 100 | 10 min. |
| Softening Point, ° F | 100 (37.7° C | 98 (36.6° C) | 99 (37.2° C) | 98 (36.6° C) | 91–113 |
| Flash Point, ° F | | | 660 (348.9° C) | | 400 min. |
| Solubility in $CCl_4$ | | | 99.55 | | 99 |
| Penetration $\frac{59/100/5}{77/100/5} \times 100$ | | | 31 | | 28 |
| TFOT (1/8") | | | | | |
| Loss on Heating, wt % | | | +.17 | | 1 max. |
| Penetration 77/100/5 | | | 128 | | |
| As % of Original | | | 79.5 | | 45 |
| Ductility 77° F (25° C) | | | 140 | | 60 |
| TFOT (1/16") | | | | | |
| Ductility 77° F (25° C) | 140 | 140 | 140 | 140 | |
| Loss on Heating, wt % | +.15 | +.22 | +.09 | +.21 | |
| Penetration 77/100/5 | 84 | | 90 | | |
| As % of Original | 46 | | 43.5 | | |

[a]6-lb sample of A-82

It will be observed from the data of Table 10, that blends A54 and A84 provided initial penetration figures very close to the limits for R200 penetration specifications. However, A82 was found to be a satisfactory blend.

An alternate method for preparing R200 grade asphalt was found in the course of experimentation. This involves adding 10 weight percent of V.T. overflash liquid to the V.T. Bottoms (original penetration of 235) and then oxidizing the blend to the penetration specifications.

The preparation of R65 penetration grade asphalt was also studied. The first approach in this study comprised the blending of the V.T. Bottoms and the P.D. tar to the penetration specification (60–70 pen) of this grade. The data of Table 11 show that both blend A97 containing 30 weight percent P.D. tar, and blend A98 with 35 weight percent P.D. tar met the specifications of the R65 grade material. Thus R65 grade asphalt can be made by first blending P.D. tar and V.T. bottom obtained as herein provided to the penetration specifications of this grade.

TABLE 11

| Blend No. | Blends of By-Product Streams R-65 Grade A-97 | A-98 | A-98-1 | A.R.R.B. Specs. |
|---|---|---|---|---|
| Composition, wt % | | | | |
| V.T. Bottoms | 70 | 65 | 65 | |
| P.D. Tar | 30 | 35 | 35 | |
| Properties | | | | |
| Viscosity (stokes) | | | | |
| at 158° F (70° C) | | | 582 | |
| at 275° F (135° C) | | | 3.77 | |
| Penetration | | | | |
| 77/100/5 | 69 | 63 | 69 | 60–70 |
| 59/100/5 | 19 | 17 | 18 | |
| $\frac{59/100/5}{77/100/5} \times 100$ | 27 | 27 | 26 | 25 min. |
| Ductility | | | | |
| at 77° F (25° C) | >140 | >140 | >140 | 75 min. |
| at 39° F (4° C) | 7/7 | 8/7 | 4/6 | 3 min. |
| Flash Point, ° F | | | 665 (351.6° C) | 437 min. |
| Softening Point, ° F | 115 (46.1° C) | 116 (46.6° C) | 116 (46.6° C) | 115–136 |
| Specific Gravity 77/77 | | | 1.0361 | .99 min. |
| Solubility in $CCl_4$, wt % | | | 99.72 | 99 min. |
| TFOT (1/8") | | | | |
| Loss on Heating, wt % | +.10 | +.11 | +.08 | |
| Penetration | | | | |
| 77/100/5 | 45 | 43 | 48 | |
| As % of Original | 65 | 68 | 70 | 60 min. |

Figure 2:
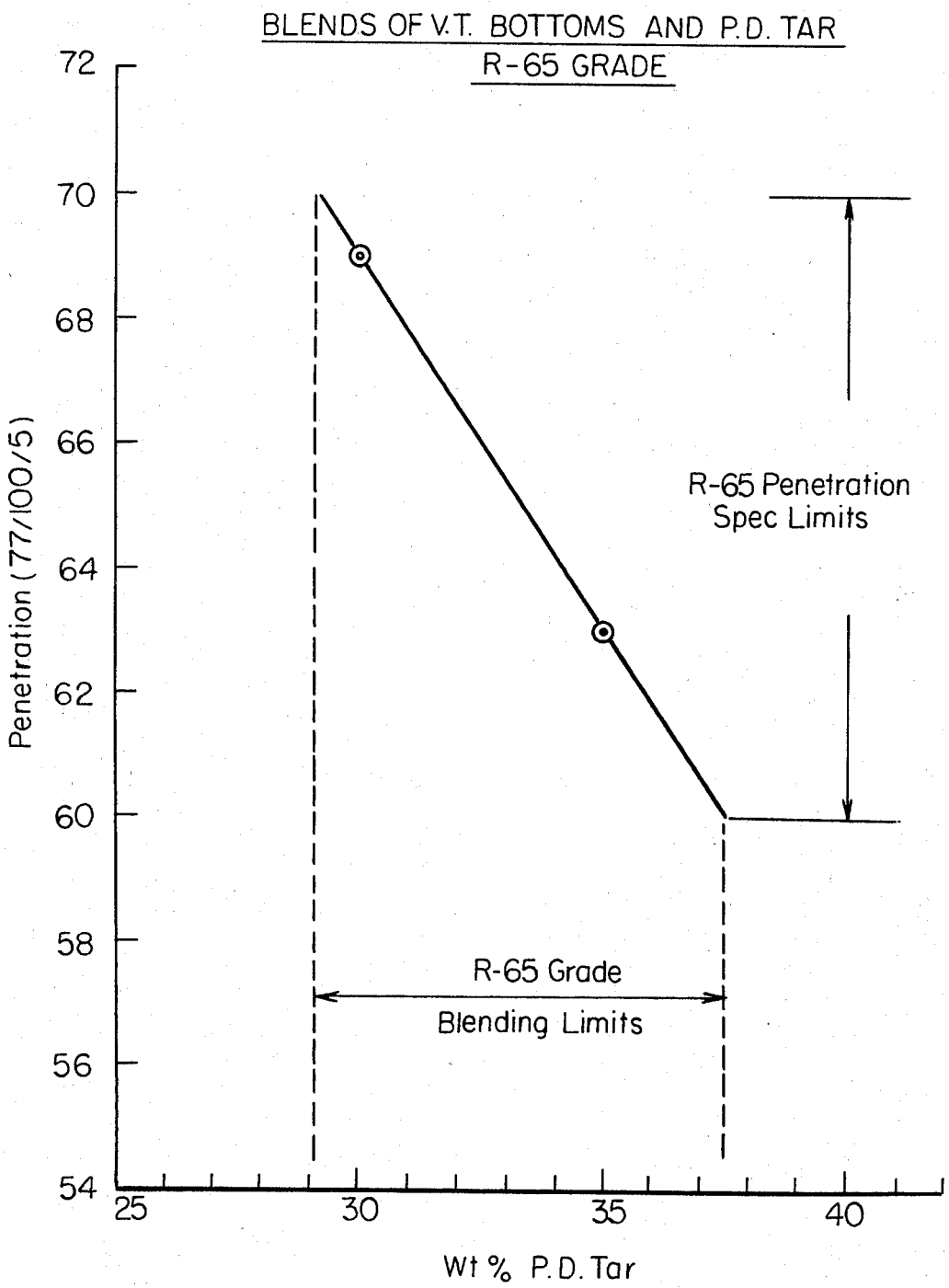

The blending limits for manufacturing the R65 asphalt can be determined from the penetration composition plot provided by FIG. 2. This plot shows that the P.D. tar concentration may be extended from a minimum of 29 weight percent to a maximum of 37.5 weight percent, it being preferred to restrict it within the range of 31 weight percent to 35 weight percent. It was also found that a blend F8–7 comprising 90 weight percent V.T. Bottoms and 10 weight percent V.T. overflash meets the critical R65 penetration grade specifications when air-blown to R65 penetration grade. This then represents an alternate method of manufacturing R65 grade asphalt.

Oxidation of the asphalt materials above identified is accomplished by air blowing. It is known from prior experience that air blowing changes the properties of this asphalt. Air blowing is usually accomplished at temperatures within the range of 400° to about 500° F. The reaction accomplished is one of dehydrogenation followed by polymerization or condensation. Blowing may be accomplished by pumping a pretreated charge through a column countercurrent to the flow of air therethrough.

Having thus generally described the invention and discussed specific embodiments going to the very essence thereof, it is to be understood that no undue restrictions are to be imposed by reason thereof except as defined by the following claims.

We claim:

1. A method for producing asphalts of specification grade defined in tables 3, 4, and 5 of the specification which comprises, preparing residual hydrocarbon components of a crude oil by vacuum distillation and solvent extraction to produce fractions selected from the group consisting of (a) a vacuum tower bottoms fraction, (b) an overflash fraction lower boiling than said vacuum tower bottoms recovered from said vacuum tower, (c) a tar product fraction obtained by solvent deasphalting a mixture of said vacuum tower bottoms and said overflash fraction, (d) a polycyclic rich furfural extract fraction obtained from a heavy oil product of propane deasphalting a mixture of said vacuum tower bottoms and said overflash fraction;

blending two or more of said components to form an asphalt satisfying the requirements of tables 3, 4, and 5.

2. The method of claim 1 wherein the overflash material separated from the vacuum tower bottoms boils in the range of about 995° F at its 5% point and about 1,198° F at its 95% point.

3. The method of claim 1 wherein a R200 specification asphalt comprises a blend of said vacuum tower bottoms and from 5 to 10 weight percent of said overflash fraction.

4. The method of claim 1 wherein a R200 specification asphalt comprises a mixture of said vacuum tower bottoms and from 7.5 to 8 weight percent of said overflash material.

5. The method of claim 1 wherein a R65 specification asphalt is formed from a mixture comprising said vacuum tower bottoms in combination with from about 29 to about 37.5 weight percent of said propane deasphalted tar.

6. The method of claim 1 wherein a R65 asphalt is formed by combining said vacuum tower bottoms with from about 31 to about 35 weight percent of said propane deasphalted tar and oxidizing the mixture.

7. The method of claim 1 wherein a mixture of from about 90 weight percent of said vacuum tower bottoms is combined with about 10 weight percent of said overflash and thereafter oxidized to form an R65 specification asphalt.

8. The method of claim 1 wherein a R40 specification asphalt is formed by blending vacuum tower bottoms with propane deasphalted tar and less than 10 weight percent of said overflash and thereafter oxidizing the blend by air blowing.

9. The method of claim 1 wherein a R90 specification asphalt is formed by blending vacuum tower bottoms, propane deasphalted tar and furfural extract and thereafter oxidizing the blend by air blowing.

10. The method of claim 1 wherein a R200 specification asphalt is formd from a mixture of furfural extract and vacuum tower bottoms.

11. The method of claim 3 wherein the blend is thereafter oxidized by air blowing.

12. The method of claim 4 wherein the blend is thereafter oxidized by air blowing.

13. The method of claim 10 wherein the blend is thereafter oxidized by air blowing.

14. The method of claim 1 wherein a R90 asphalt comprises a blend of vacuum tower bottoms, propane deasphalted tar and less than 10 weight percent of said overflash material.

* * * * *

UNITED STATES PATENT AND TRADEMARK OFFICE

CERTIFICATE OF CORRECTION

PATENT NO. : 3,989,616

DATED : November 2, 1976

INVENTOR(S) : Charles A. Pagen and Richard J. Petrucco

It is certified that error appears in the above-identified patent and that said Letters Patent are hereby corrected as shown below:

| | |
|---|---|
| Column 3, Line 23 | Delete the word "aromatic" appearing before the word "solvent". |
| Column 7, Line 20 | "rade" should read --grade--. |
| Column 8, Table 4 | Under Bitumen $ 200 max., "13" should read -- - --. |
| Column 11 and 12, Table 8 | Under F-8-31, ";30 .20" should read --+.20--. |
| Column 12, Line 18 | "meet" should read --met--. |

Signed and Sealed this

Twenty-second Day of February 1977

[SEAL]

*Attest:*

RUTH C. MASON
*Attesting Officer*

C. MARSHALL DANN
*Commissioner of Patents and Trademarks*